US009384614B2

(12) United States Patent
Nagoya et al.

(10) Patent No.: US 9,384,614 B2
(45) Date of Patent: Jul. 5, 2016

(54) COIN DISPENSING DEVICE AND DRAWER

(71) Applicant: GLORY LTD., Himeji-shi, Hyogo-ken (JP)

(72) Inventors: Tatsuo Nagoya, Himeji (JP); Kazuhiko Takahashi, Himeji (JP); Kenichiro Akita, Himeji (JP)

(73) Assignee: GLORY LTD., Himeji-shi, Hyogo-ken (JP)

( * ) Notice: Subject to any disclaimer, the term of this patent is extended or adjusted under 35 U.S.C. 154(b) by 0 days.

(21) Appl. No.: 13/927,917

(22) Filed: Jun. 26, 2013

(65) Prior Publication Data

US 2014/0001198 A1 Jan. 2, 2014

(30) Foreign Application Priority Data

Jun. 29, 2012 (JP) ..... 2012-147471

(51) Int. Cl.
*G07D 1/00* (2006.01)
*G07D 9/00* (2006.01)

(52) U.S. Cl.
CPC ..... *G07D 1/00* (2013.01); *G07D 9/002* (2013.01); *G07D 9/008* (2013.01)

(58) Field of Classification Search
CPC ..... G07D 1/00; G07D 9/02; G07D 9/06; G07D 2201/00
USPC ..... 453/18, 63; 312/270.3, 273, 249.4, 309, 312/330.1, 348.3; 232/59, 64; 194/344, 194/346, 350; 221/92, 99; 235/22
See application file for complete search history.

(56) References Cited

U.S. PATENT DOCUMENTS

| | | | | |
|---|---|---|---|---|
| 5,830,054 | A | 11/1998 | Petri | |
| 6,196,913 | B1 * | 3/2001 | Geib et al. | 453/10 |
| 7,625,272 | B1 * | 12/2009 | Moreland et al. | 453/3 |
| 8,109,379 | B2 * | 2/2012 | Sjostrom | 194/215 |
| 8,251,198 | B2 * | 8/2012 | Zwieg et al. | 194/217 |
| 2011/0127286 | A1 * | 6/2011 | Tabata et al. | 221/8 |

FOREIGN PATENT DOCUMENTS

| | | |
|---|---|---|
| EP | 1 734 489 A2 | 12/2006 |
| EP | 2 175 429 A2 | 4/2010 |

OTHER PUBLICATIONS

European Search Report (Application No. 13174221.5) (5 pages—dated Jan. 31, 2014).

* cited by examiner

*Primary Examiner* — Mark Beauhaine
(74) *Attorney, Agent, or Firm* — Renner, Kenner, Greive, Bobak, Taylor & Weber

(57) ABSTRACT

A drawer 72 includes a coin container receiving unit 74 and a plurality of types of coin containers 76*a*, 76*b* having different shapes, each of the coin containers 76*a*, 76*b* can be placed in the coin container receiving unit 74, and wherein a number of the coin containers 76*a*, 76*b* installed in the drawer 72 is changeable according to a combination of the types of the coin containers 76*a*, 76*b* placed in the coin container receiving unit 74.

10 Claims, 13 Drawing Sheets

COIN DISPENSING DEVICE AND DRAWER

RELATED ART

This application claims the benefit of priority from the prior Japanese Patent Application No. 2012-147471 filed on Jun. 29, 2012, the entire contents of which are incorporated herein by reference.

FIELD OF THE INVENTION

The present invention relates to a coin dispensing device which dispenses coins and a drawer provided in the coin dispensing device.

BACKGROUND OF THE INVENTION

Conventionally, various types of coin dispensing devices which dispense coins are known. For example, U.S. Pat. No. 5,830,054 discloses an invention of a coin dispensing device, in which coins dispensed from a coin dispensing unit are delivered through a chute to a drawer and stored in the drawer, and the coins are dispensed by taking this drawer to the outside of a casing of the coin dispensing device. In U.S. Pat. No. 5,830,054, a plurality of storing units are defined in the drawer, and the coins are stored separately in each storing unit according to the denomination.

SUMMARY OF THE INVENTION

In the conventional coin dispensing device such as the one disclosed in U.S. Pat. No. 5,830,054, the plurality of storing units are predefined in the drawer, and the coins are stored separately in each storing unit according to the denomination. However, there is a problem that, since a number of denominations of coins to be handled varies from country to country, the configuration of the chute or the drawer of the dispensing system needs to be changed according to the corresponding country. Especially in a country where the number of denominations of coins to be handled is small, setting of denominations of coins to be stored in each storing unit in the drawer cannot be flexibly adapted. Another problem is that, when one tries to dispense a large amount of coins of a particular denomination, the large amount of coins of the particular denomination cannot be dispensed due to a limited capacity of each storing unit.

The present invention has been made in consideration of the above problems, and an object thereof is to provide a coin dispensing device and a drawer in which a plurality of coin containers having different shapes can be placed in a coin container receiving unit and a number of the coin containers installed in the drawer can be changed according to a combination of each type of the coin containers placed in the coin container receiving unit, so that a number of the coin containers in the drawer can be changed according to the number of denominations of coins to be handled, and, moreover, when one wishes to dispense a large amount of coins of a particular denomination, the large amount of coins of the particular denomination can be dispensed by using the coin container having a large capacity as the coin container corresponding to the particular denomination.

A coin dispensing device in accordance with the present invention comprises:

a plurality of coin storing units respectively configured to store coins and dispense the stored coins; and a drawer configured to receive the coins dispensed from each coin storing unit, the drawer including a coin container receiving unit and a plurality of types of coin containers having different shapes, each of the coin containers being able to be placed in the coin container receiving unit, wherein a number of the coin containers installed in the drawer is changeable according to a combination of the types of the coin containers placed in the coin container receiving unit.

According to such a coin dispensing device, the drawer includes the coin container receiving unit and the plurality of types of coin containers having different shapes each of which can be placed in the coin container receiving unit, and the number of the coin containers installed in the drawer is changeable according to a combination of different types of the coin containers placed in the coin container receiving unit. This makes it possible to change the number of the coin containers in the drawer according to the number of denominations of coins to be handled. In addition, when one wishes to dispense a large amount of coins of a particular denomination, the large amount of coins of the particular denomination can be dispensed by using the coin container having a large capacity as the coin container corresponding to the particular denomination.

The coin dispensing device in accordance with the present invention may further comprise a moving member configured to be attachable to and detachable from the drawer, the moving member being movable between a first position, where the coins dispensed from each coin storing unit is delivered into the drawer, and a second position, where the coins stored in each coin container in the drawer is removable from each coin container.

In the coin dispensing device in accordance with the present invention, the drawer may be provided with a coin container detecting unit configured to detect a type and a position of each coin container placed in the coin container receiving unit.

The coin dispensing device in accordance with the present invention may further comprise denomination setting unit configured to set a denomination of a coin to be stored in each coin storing unit.

The coin dispensing device in accordance with the present invention may further comprise abnormal state outputting unit configured to output information that the coin dispensing device is in an abnormal state, when a combination of the types of the coin containers placed in the coin container receiving unit in the drawer and a denomination of the coins to be stored in each coin storing unit are set so as to store the coins of a plurality of denominations, dispensed from different coin storing units, into one coin container in the drawer.

In the coin dispensing device in accordance with the present invention, at least one of the coin containers in the drawer may be configured to store the coins dispensed from one of the coin storing units.

In the coin dispensing device in accordance with the present invention, at least one of the coin containers in the drawer may be configured to store the coins dispensed from two or more of the coin storing units.

In the coin dispensing device in accordance with the present invention, the plurality of coin storing units may be disposed in a plurality of rows in a horizontal plane.

In the coin dispensing in accordance with the present invention, the plurality of coin containers may be disposed in a plurality of rows in the coin container receiving unit, and a number of the rows of the coin storing units is equal to a number of the rows of the coin containers.

In the coin dispensing in accordance with the present invention, an opening may be provided at a bottom part of the coin container receiving unit where each coin container is to be placed, and a collecting unit configured to collect the coins can be installed under the coin container receiving unit.

A drawer in accordance with the present invention comprises:

a coin container receiving unit; and a plurality of types of coin containers having different shapes, each of the coin containers being able to be placed in the coin container receiving unit, wherein a number of the coin containers installed is changeable according to a combination of the types of the coin containers placed in the coin container receiving unit.

According to such a drawer, since the number of the coin containers installed is changeable according to a combination of different types of the coin containers placed in the coin container receiving unit, the number of the coin containers is changeable according to the number of denominations of coins to be handled. In addition, when one wishes to dispense a large amount of coins of a particular denomination, the large amount of coins of the particular denomination can be dispensed by using the coin container having a large capacity as the coin container corresponding to the particular denomination.

According to the coin dispensing device and the drawer of the present invention, the number of the coin containers in the drawer can be changed according to the number of denominations of coins to be handled, and, moreover, when one wishes to dispense a large amount of coins of a particular denomination, the large amount of coins of the particular denomination can be dispensed by using the coin container having a large capacity as the coin container corresponding to the particular denomination.

DETAILED DESCRIPTION OF THE INVENTION

Figure 1:
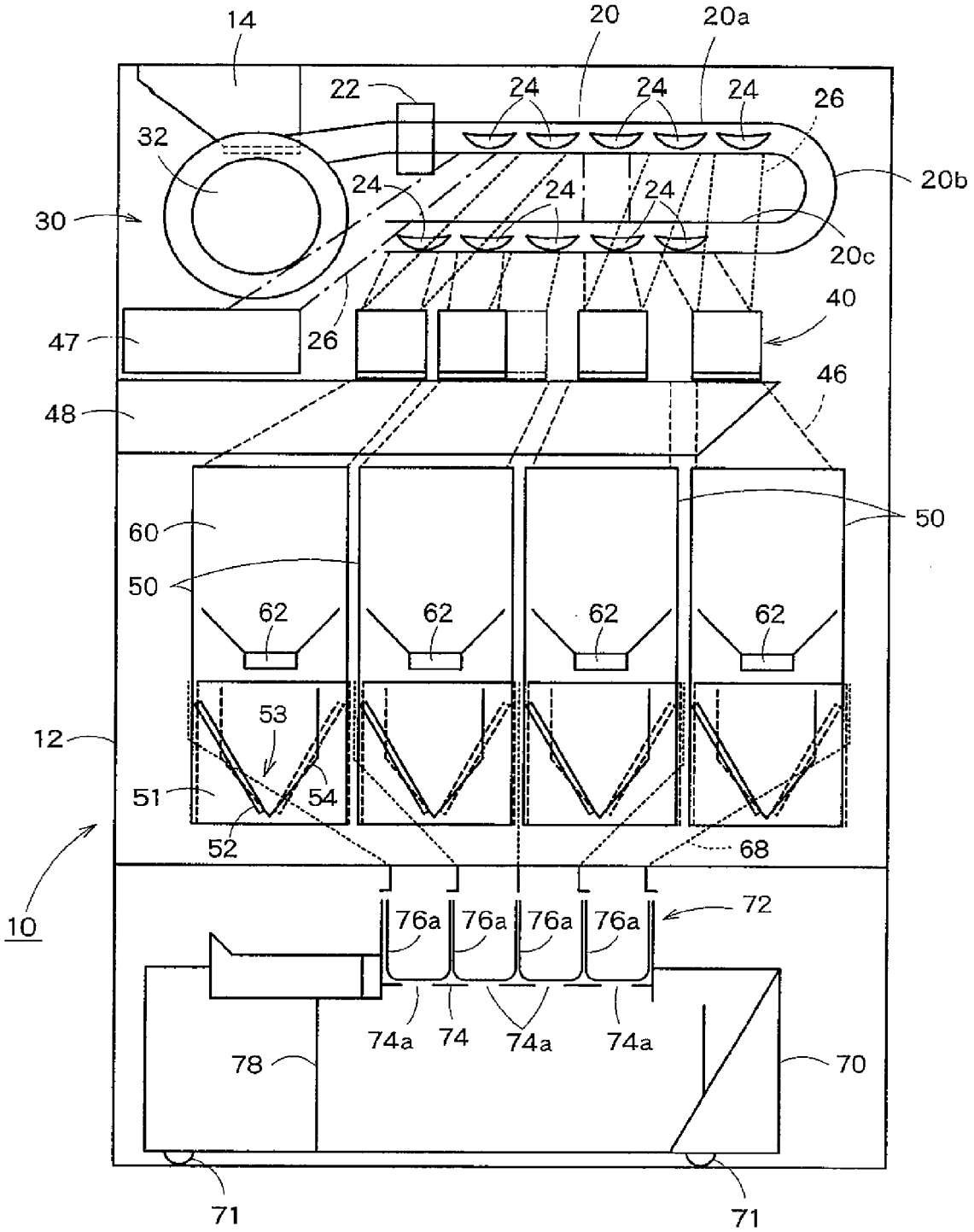
FIG. 1 is a schematic side view showing an inner structure of a coin depositing and dispensing machine in one embodiment of the present invention.
Figure 2:
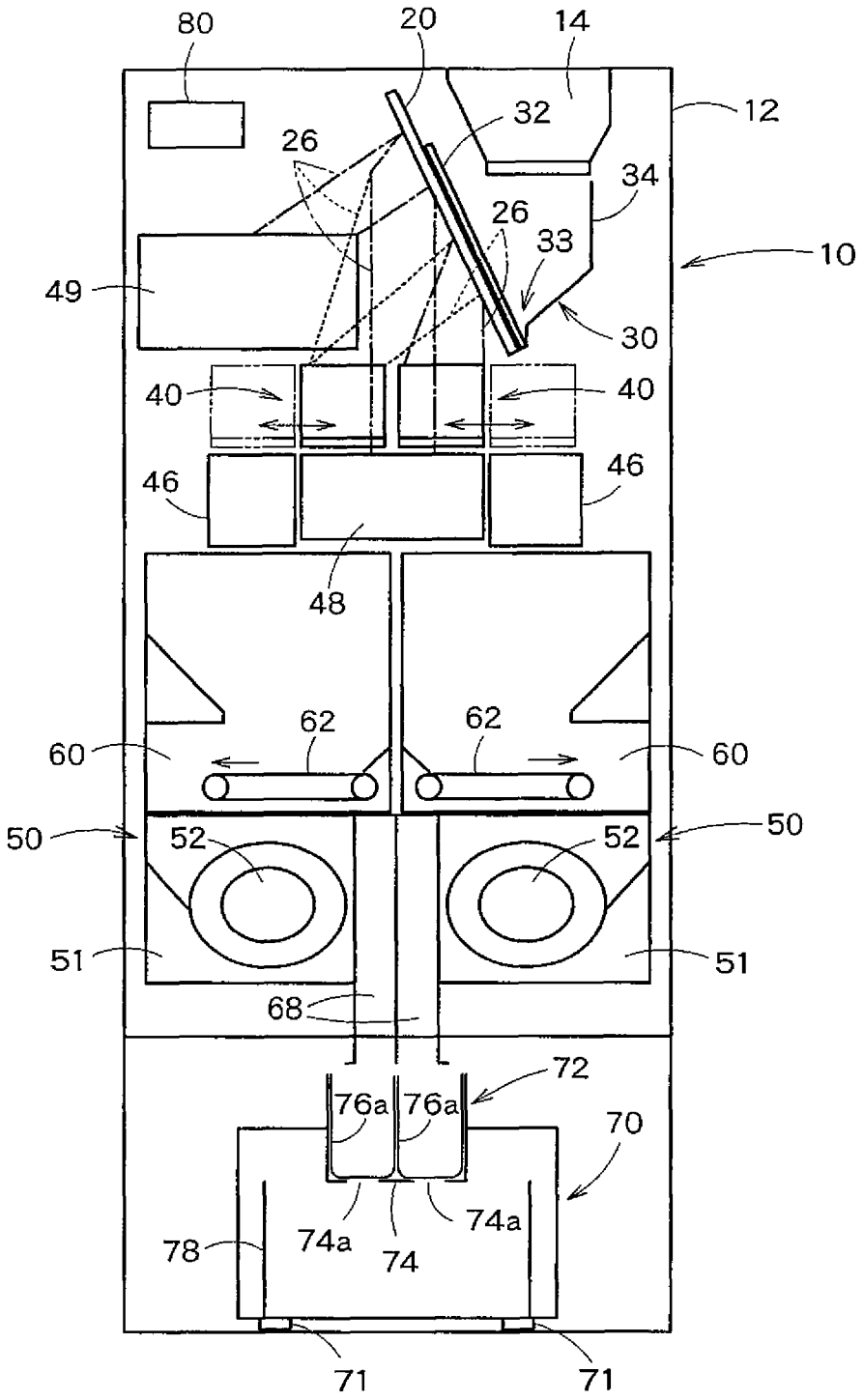
FIG. 2 is a front view showing the coin depositing and dispensing machine shown in FIG. 1.
Figure 3:
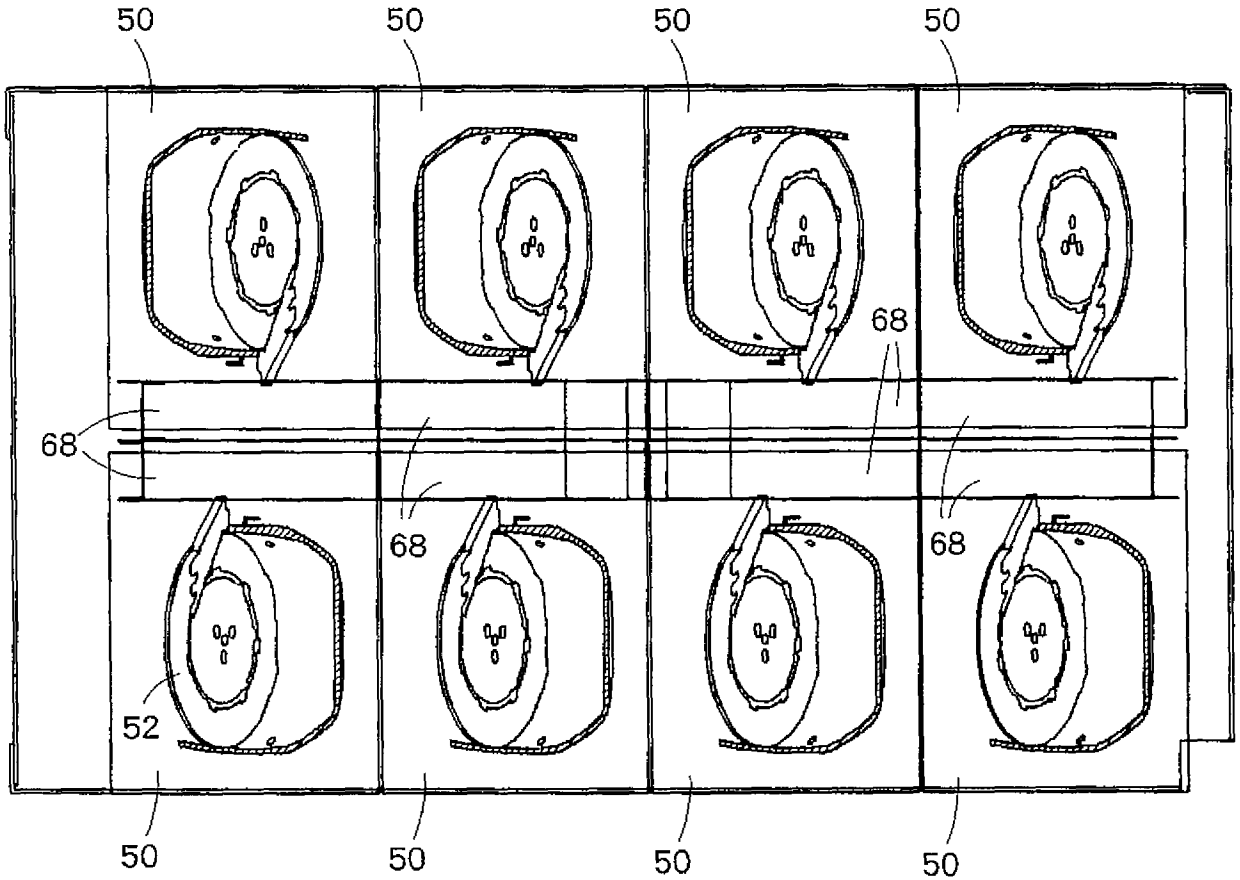
FIG. 3 is a top view showing a configuration of each storing and feeding device in the coin depositing and dispensing machine shown in FIG. 1, etc.
Figure 4:
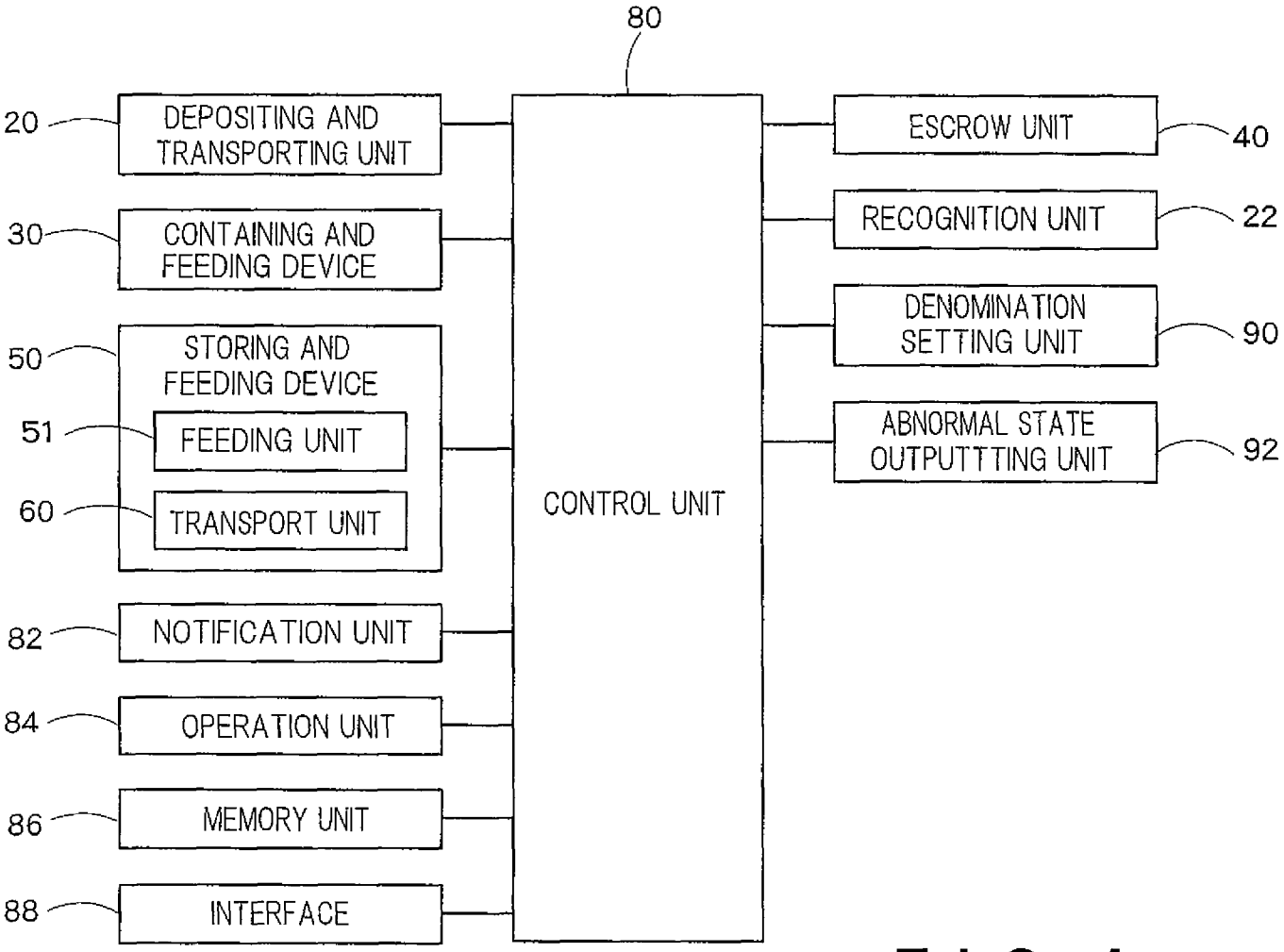
FIG. 4 is a functional block diagram of the coin depositing and dispensing machine shown in FIG. 1, etc.
Figure 5A:
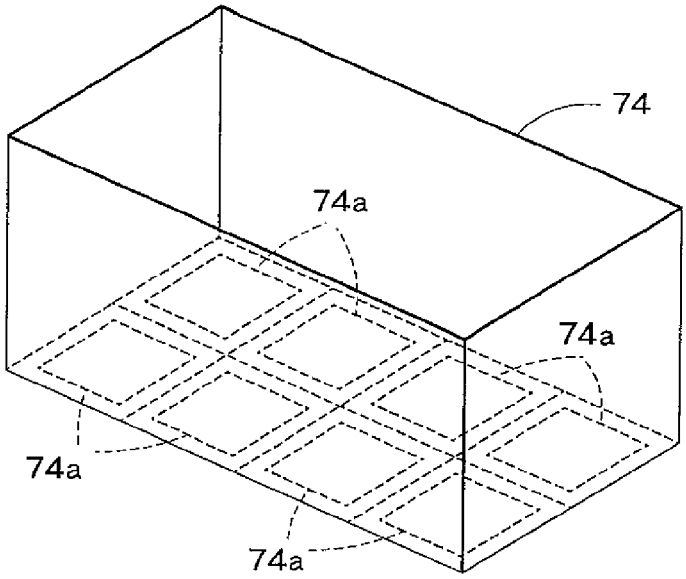
FIG. 5A is a perspective view showing a configuration of a coin container receiving unit in a drawer provided in the coin depositing and dispensing machine shown in FIG. 1, etc.
Figure 5B:
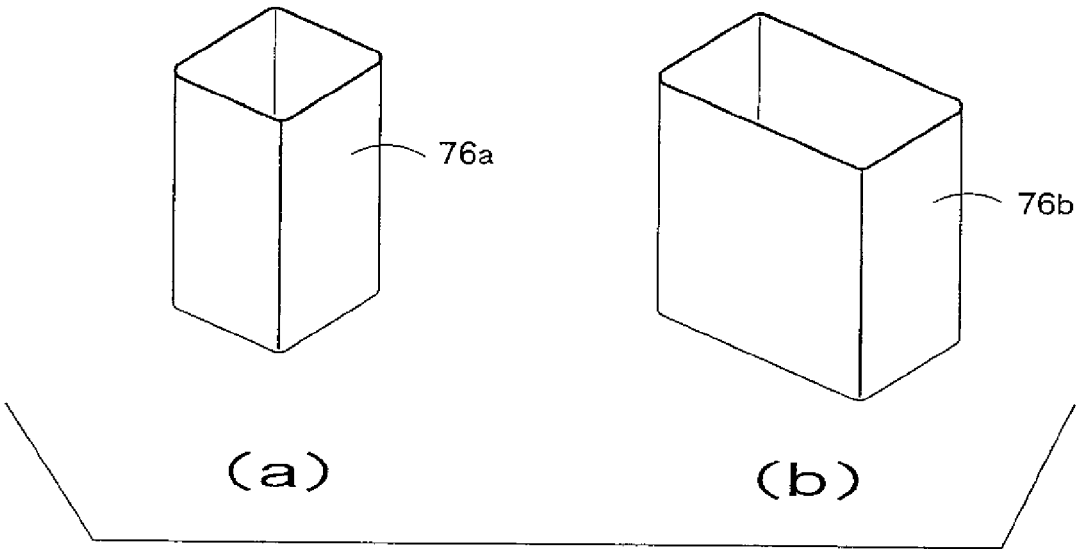
FIGS. 5B (a) and (b) are perspective views showing a configuration of each type of coin containers in the drawer provided in the coin depositing and dispensing machine shown in FIG. 1, etc.
Figure 5C:
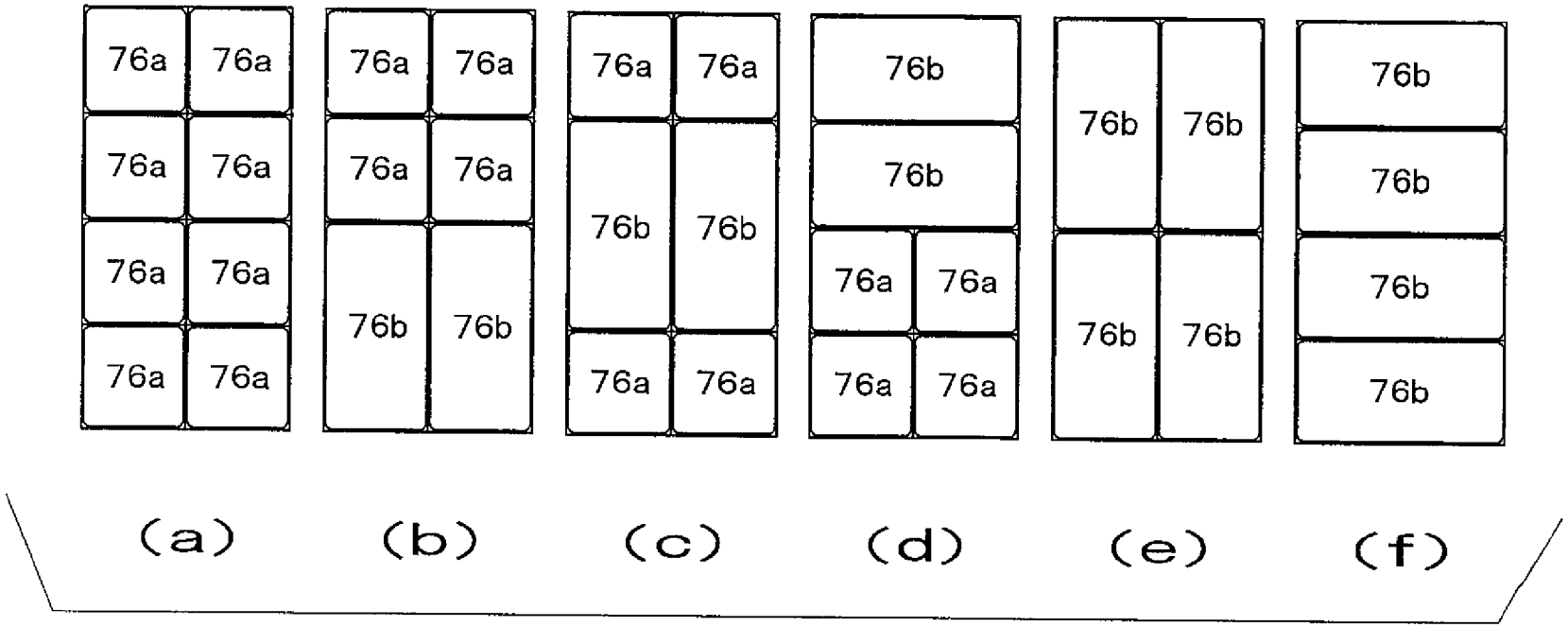
FIGS. 5C (a) to (f) are views showing various patterns of combinations of the coin containers placed in the coin container receiving unit.
Figure 6:
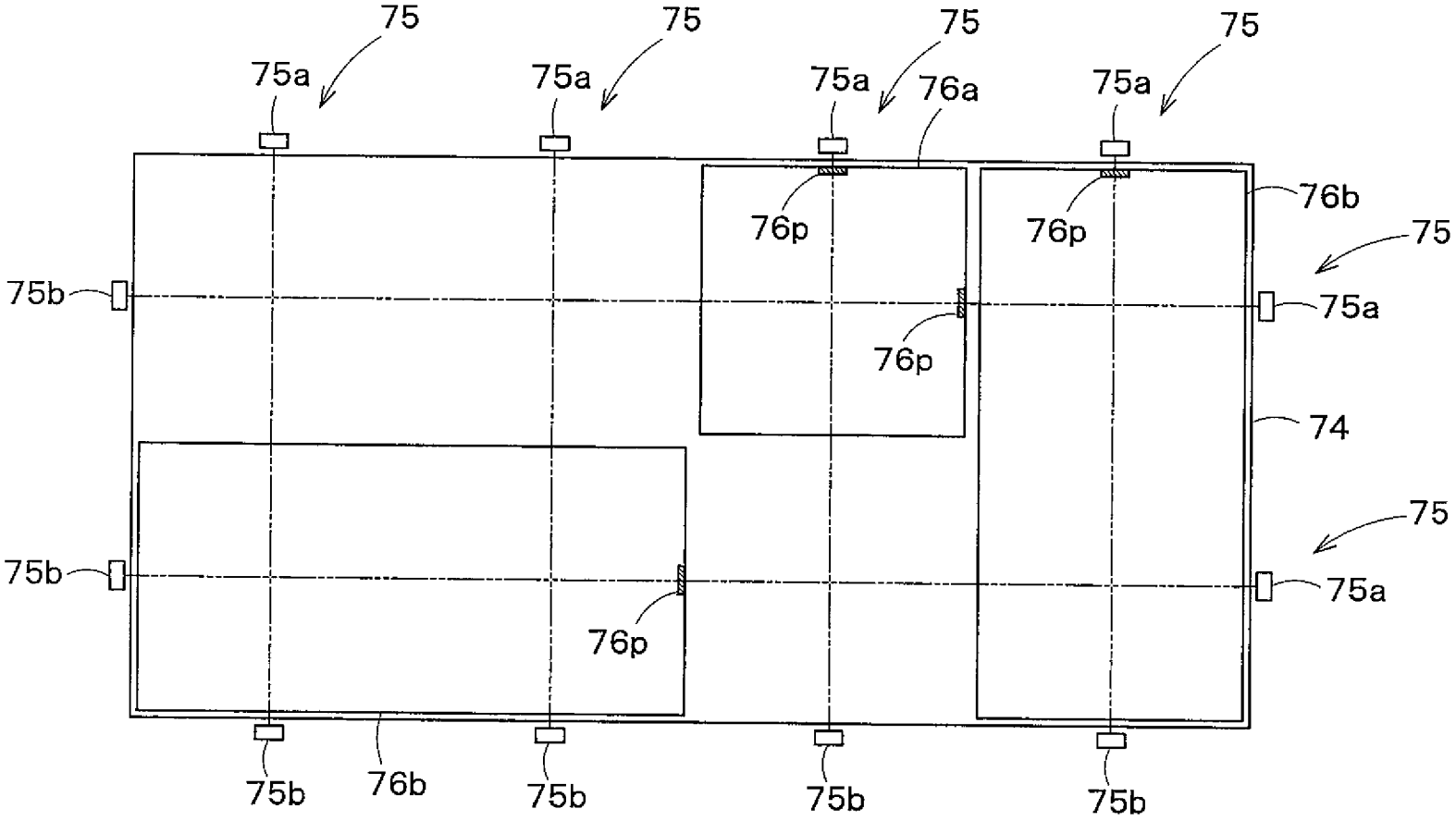
FIG. 6 is a top view showing a configuration of coin container detecting sensors provided in the drawer.
Figure 7:
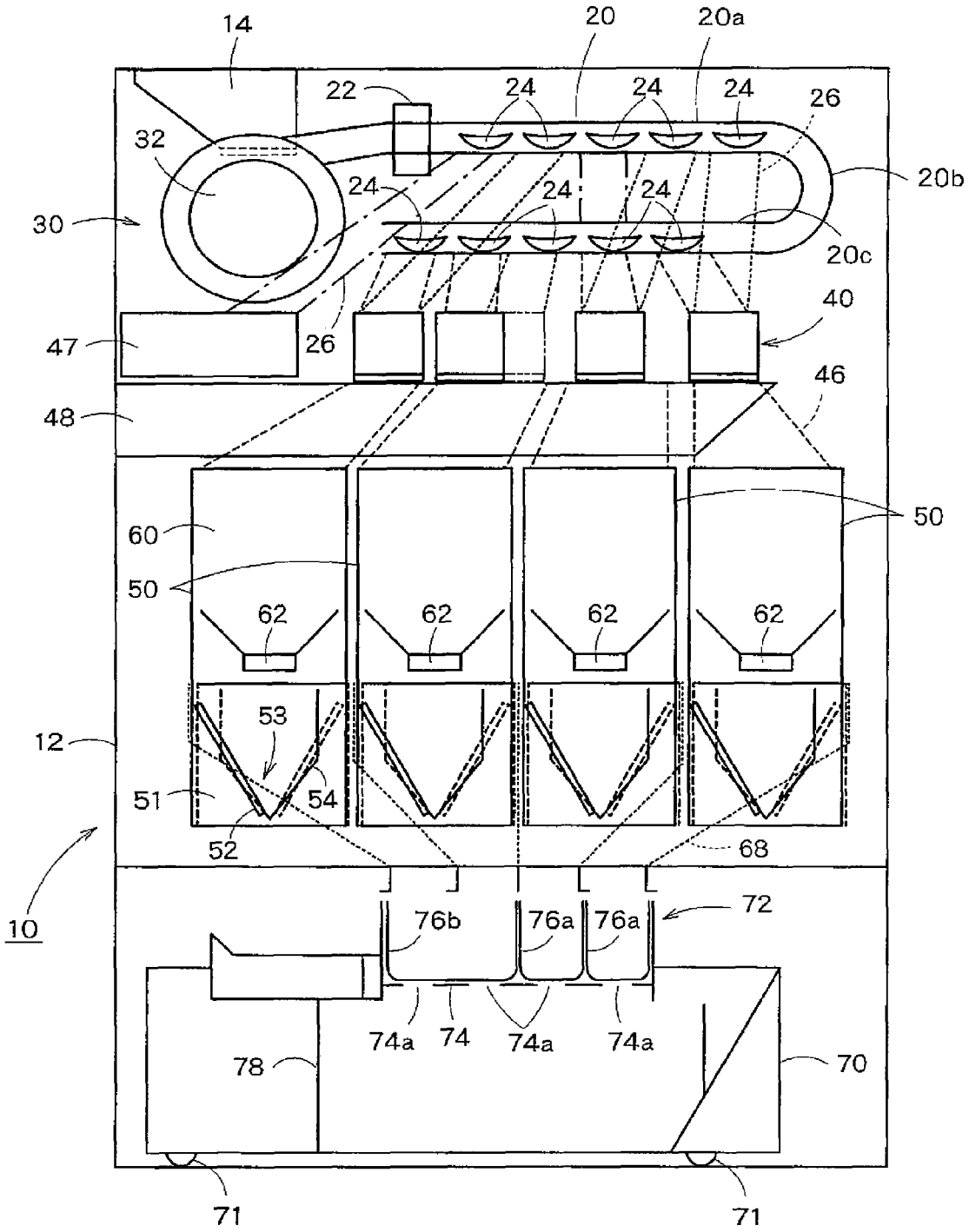
FIG. 7 is a side view showing the coin depositing and dispensing machine when the coin containers are placed in the coin container receiving unit in a pattern as shown in FIG. 5C (b)
Figure 8:
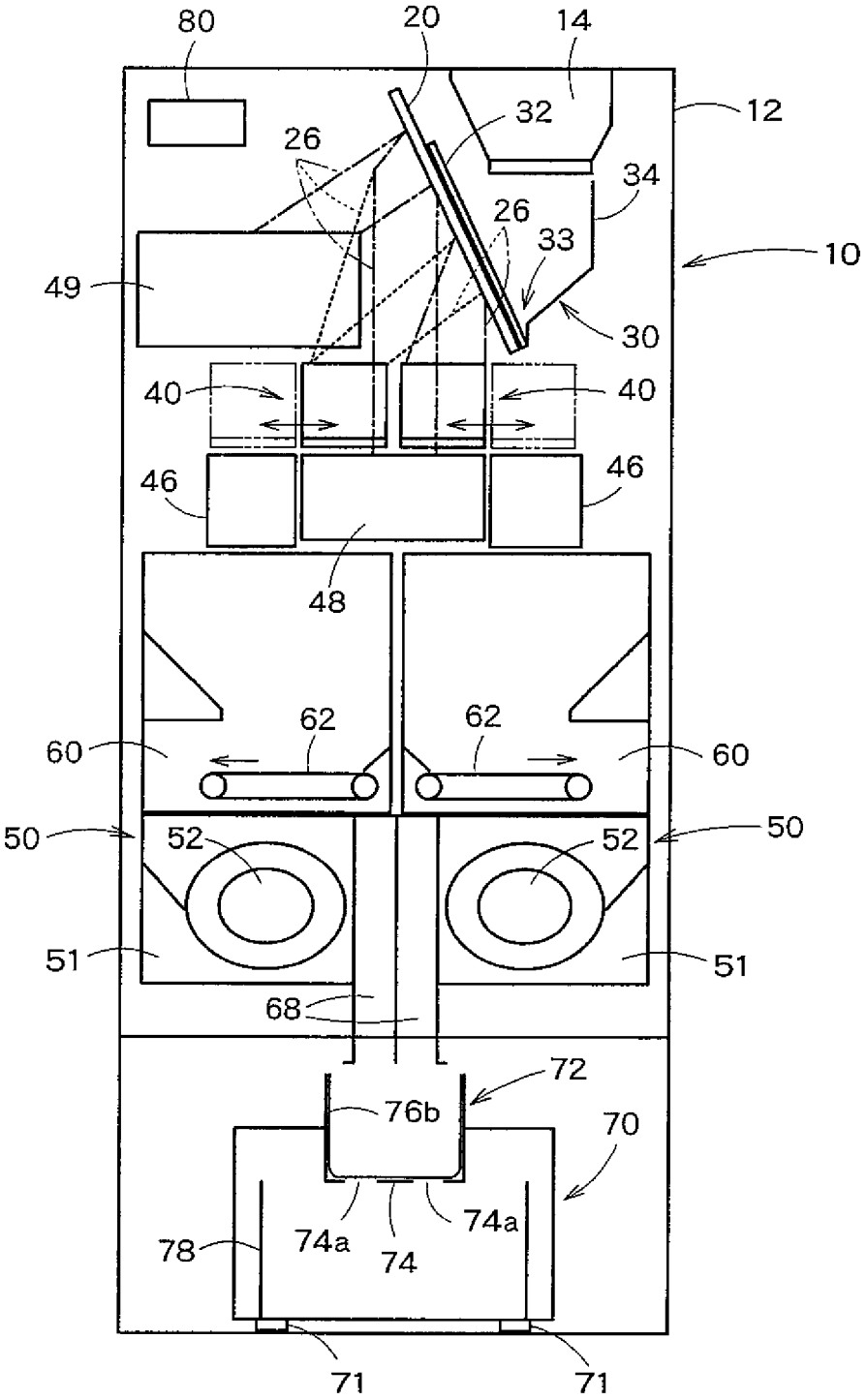
FIG. 8 is a front view showing the coin depositing and dispensing machine when the coin containers are placed in the coin container receiving unit in a pattern as shown in FIG. 5C (f)
Figure 9:
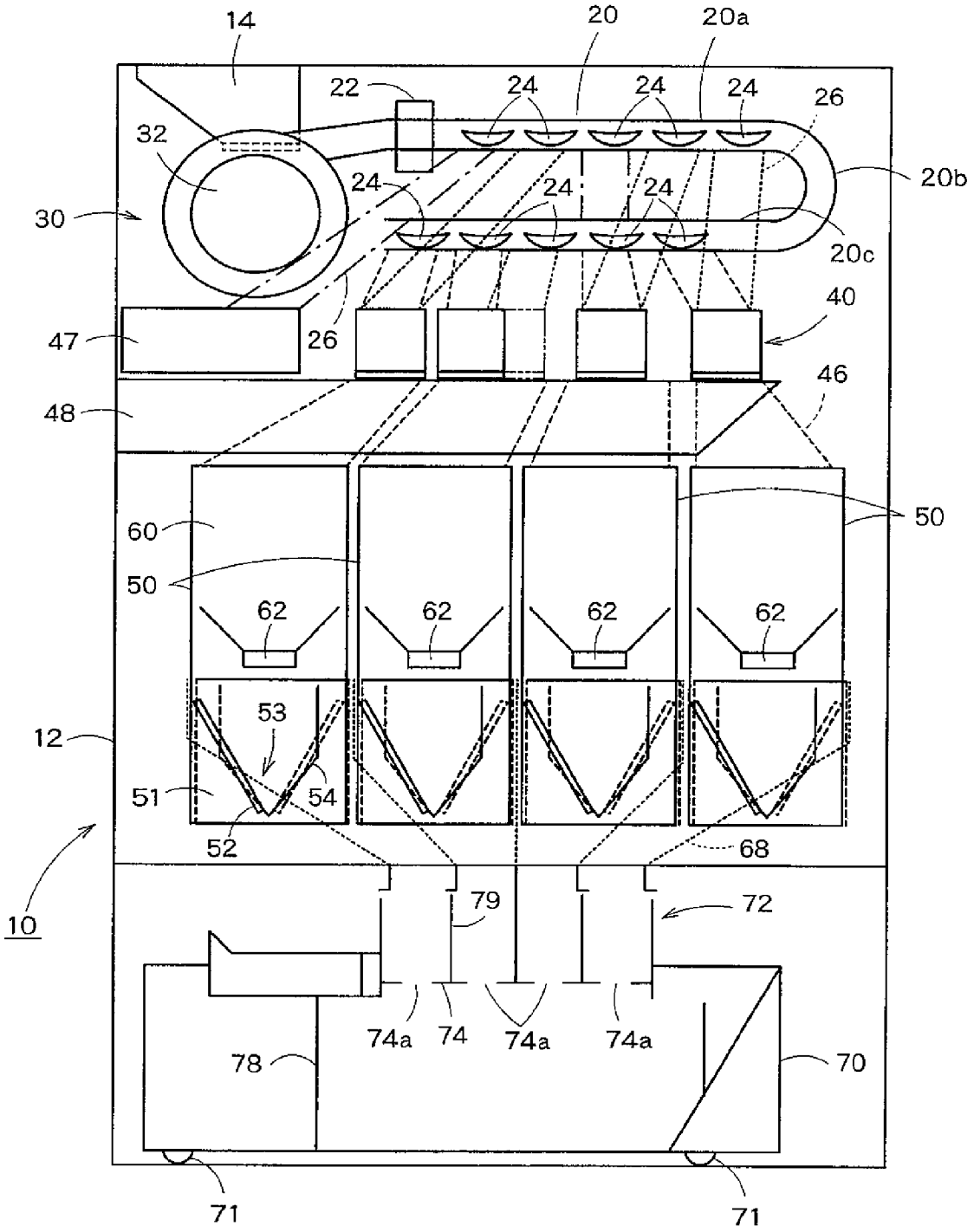
FIG. 9 is a side view showing the coin depositing and dispensing machine when the coin containers are removed from the coin container receiving unit, in a case where a type of collecting box to store coins of a plurality of denominations mixed together in one compartment is mounted on a carriage.
Figure 10:
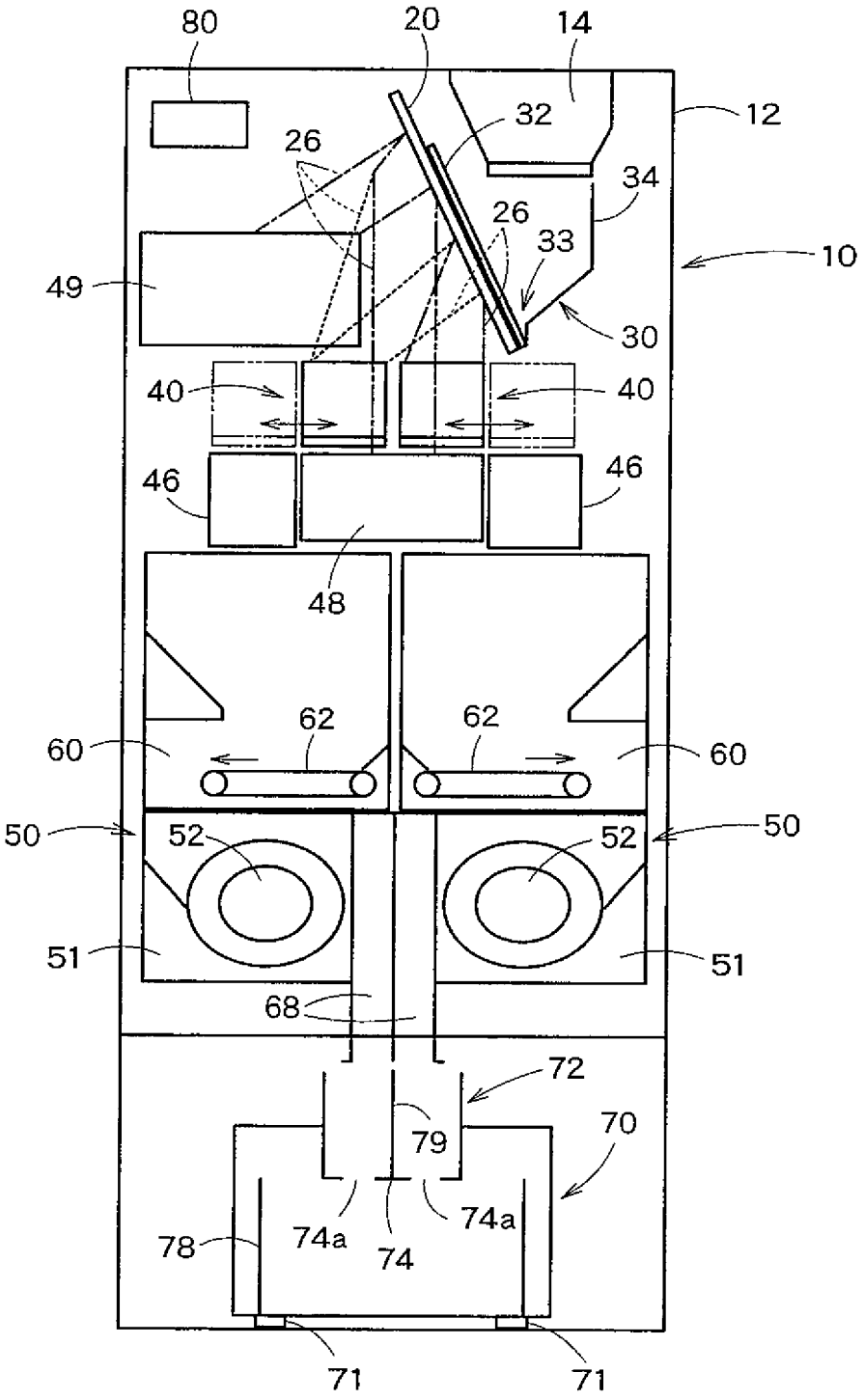
FIG. 10 is a front view showing the coin depositing and dispensing machine when the coin containers are removed from the coin container receiving unit, in a case where the type of collecting box to store coins of a plurality of denominations mixed together in one compartment is mounted on the carriage.
Figure 11:
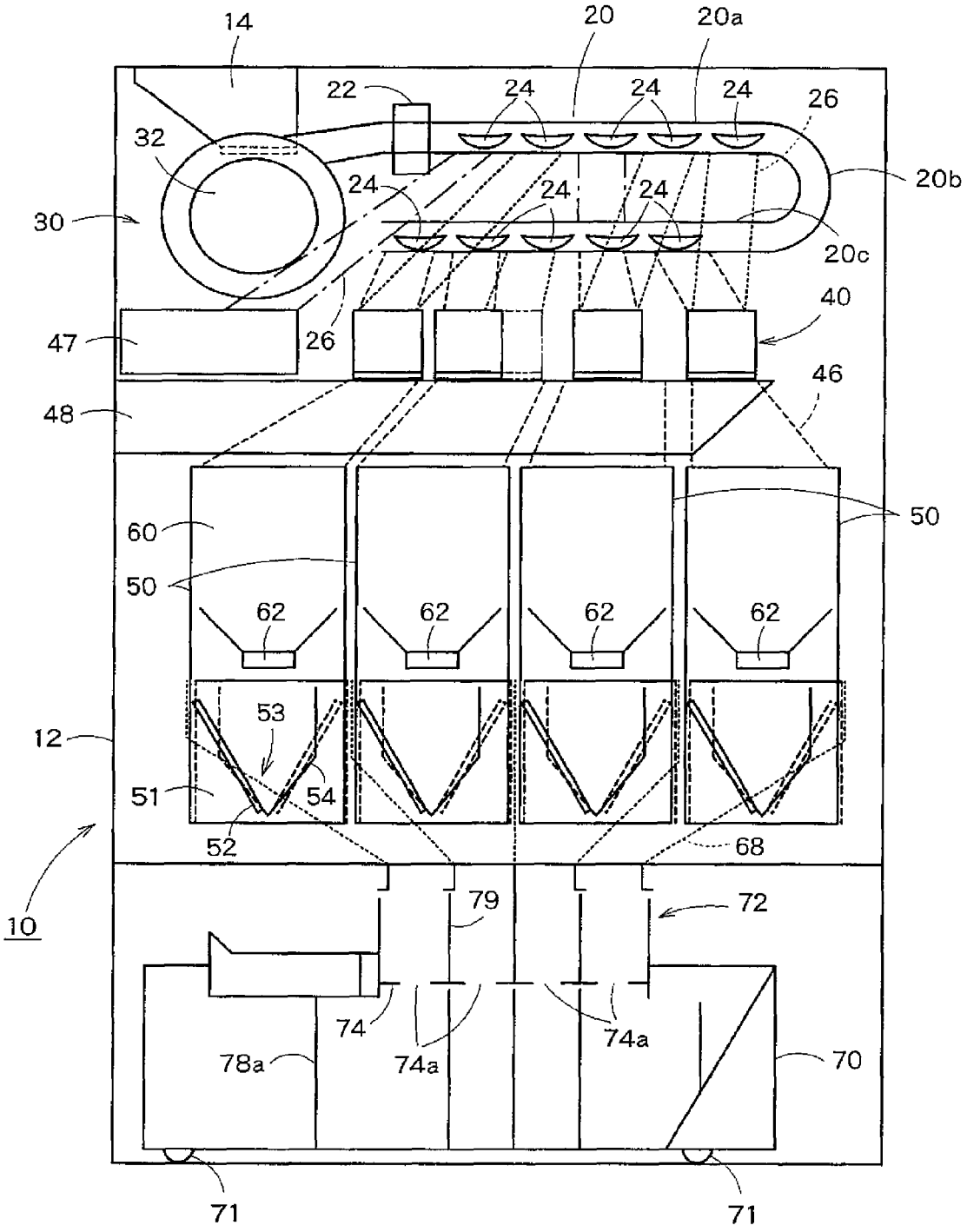
FIG. 11 is a side view showing the coin depositing and dispensing machine when the coin containers are removed from the coin container receiving unit, in a case where a type of collecting box to store coins separately in a plurality of compartments according to the denomination is mounted on the carriage.
Figure 12:
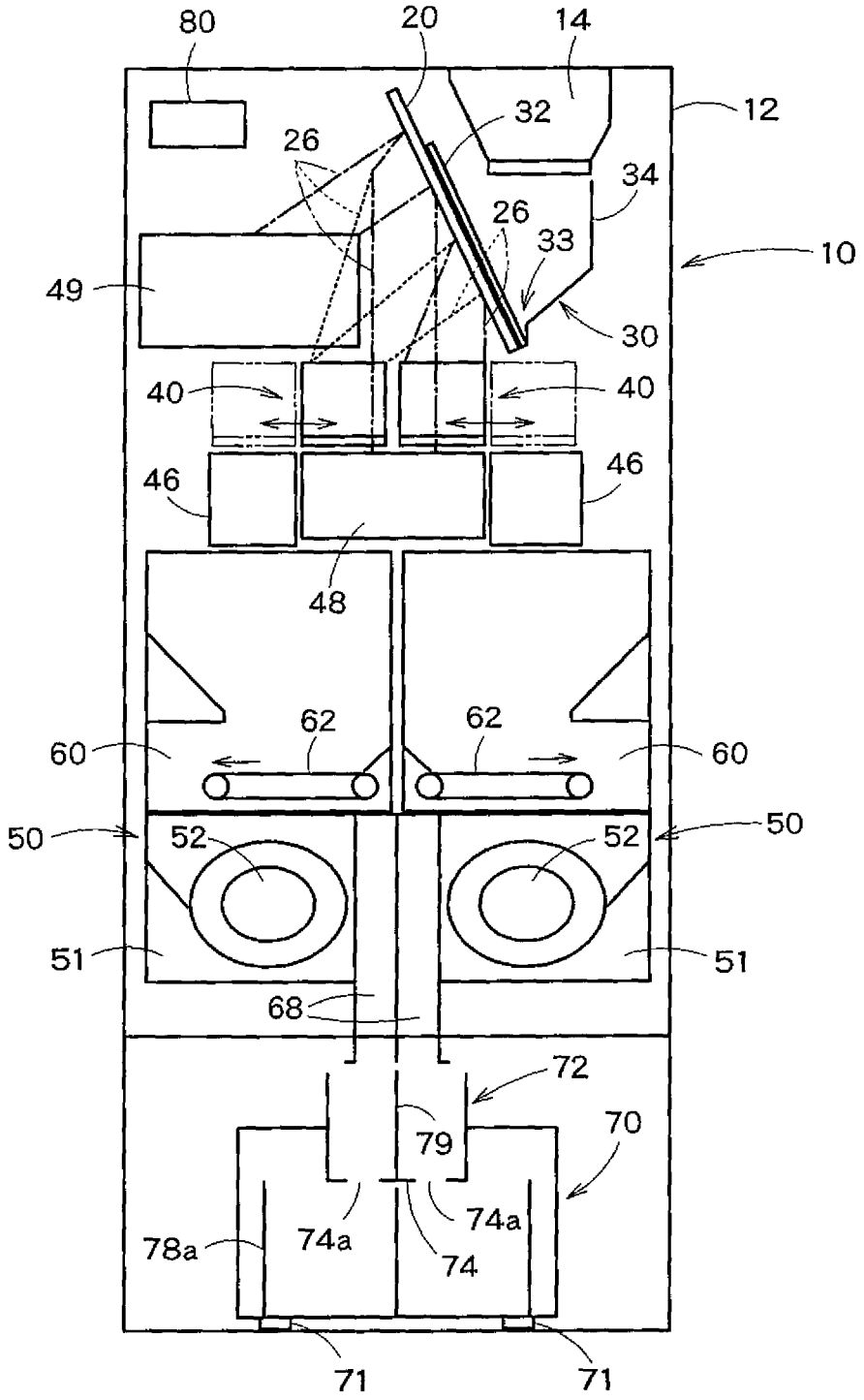
FIG. 12 is a front view showing the coin depositing and dispensing machine when the coin containers are removed from the coin container receiving unit, in a case where the type of collecting box to store coins separately in a plurality of compartments according to the denomination is mounted on the carriage.

Hereinafter, one embodiment of the present invention will be described with reference to the drawings. FIGS. 1 to 12 are views showing a coin depositing and dispensing machine according to the present embodiment as follows. FIG. 1 is a schematic side view showing an inner structure of the coin depositing and dispensing machine according to the present embodiment, and FIG. 2 is a front view showing the coin depositing and dispensing machine shown in FIG. 1. FIG. 3 is a top view showing a configuration of each storing and feeding device in the coin depositing and dispensing machine shown in FIG. 1, etc. FIG. 4 is a functional block diagram of the coin depositing and dispensing machine shown in FIG. 1, etc. Each of FIGS. 5A to 5C is a view showing a configuration of a drawer provided in the coin depositing and dispensing machine shown in FIG. 1, etc., and FIG. 6 is a top view showing a configuration of coin container detecting sensors provided in the drawer. FIG. 7 is a side view showing the coin depositing and dispensing machine when the coin containers are placed in a coin container receiving unit in a pattern as shown in FIG. 5C (b), and FIG. 8 is a front view showing the coin depositing and dispensing machine when the coin containers are placed in the coin container receiving unit in a pattern as shown in FIG. 5C (f). FIGS. 9 and 10 are a side view and a front view, respectively, showing the coin depositing and dispensing machine when the coin containers are removed from the coin container receiving unit, in a case where a type of collecting box to store coins of a plurality of denominations mixed together in one compartment is mounted on a carriage, and FIGS. 11 and 12 are a side view and a front view, respectively, showing the coin depositing and dispensing machine when the coin containers are removed from the coin container receiving unit, in a case where a type of collecting box to store coins separately in a plurality of compartments according to the denomination is mounted on the carriage.

As shown in FIGS. 1 and 2, a coin depositing and dispensing machine 10 includes: a substantially rectangular parallelepiped casing 12; a coin receiving unit 14 which receives coins from an outside of the casing 12; and a containing and feeding device 30 which the coins received by the coin receiving unit 14 are delivered to and contained in, and feeds the contained coins one by one. In addition, a depositing and transporting unit 20 is provided which transports the coins fed from the containing and feeding device 30 one by one in the casing 12. The depositing and transporting unit 20 includes: an upper transport part 20*a* extending in a substantially horizontal direction; a return transport part 20*b* which transports the coins delivered from the upper transport part 20*a*, and in so doing, changes a transporting direction of the coins to a reverse direction; and a lower transport part 20*c* which is provided at a lower side of the upper transport part 20*a*, extends in a substantially horizontal direction, and transports the coins delivered from the return transport part 20*b*. The coins fed from the containing and feeding device 30 are transported to the upper transport part 20*a*, the return transport part 20*b*, and the lower transport part 20*c*, in this order. The depositing and transporting unit 20 is provided with: a recognition unit 22 which recognizes coins transported by the depositing and transporting unit 20; and a sorting unit 24 which sorts the coins on the basis of results of coin recognition by the recognition unit 22.

As shown in FIG. 2, etc., a pair of left and right escrow units 40 is provided inside the casing 12 at the lower side of the depositing and transporting unit 20. The coins sorted by the sorting unit 24 are delivered through chutes 26 to these escrow units 40, and held in escrow there in a state classified by denomination. In addition, a plurality of (specifically, eight) storing and feeding devices 50 are provided at the lower side of the escrow units 40. The coins held in escrow in the escrow unit 40 are delivered from the escrow units 40 through chutes 46 to each storing and feeding device 50 and stored there. Each storing and feeding device 50 feeds the coins stored in the storing and feeding device 50 one by one. Here, as shown in FIG. 3, the plurality of storing and feeding devices 50 are arranged in a plurality of rows along a horizontal plane.

As shown in FIGS. 1 and 2, a carriage 70 is provided inside the casing 12 at the lower side of the storing and feeding devices 50. A drawer 72 is provided in this carriage 70 in an attachable/detachable manner, and the coins fed from each storing and feeding device 50 are delivered to the drawer 72 and stored there. A configuration of the drawer 72 will be described in detail later. A collecting box 78 is provided at the lower side of the drawer 72 in the carriage 70 in an attachable/detachable manner.

A control unit 80 which controls each component of the coin depositing and dispensing machine 10 is provided inside the casing 12 of the coin depositing and dispensing machine 10.

The following is a detailed description of each component of the coin depositing and dispensing machine 10 configured as described above.

As shown in FIGS. 1 and 2, the coin receiving unit 14 which receives coins deposited from outside the casing 12 to the inside is provided at an upper part of the casing 12, and the coins received by the coin receiving unit 14 are delivered to the containing and feeding device 30 by their own weight. The coins delivered from the coin receiving unit 14 to the containing and feeding device 30 are temporarily contained in the containing and feeding device 30.

The containing and feeding device 30 includes: a centrifugal disk 32 which is inclined to a vertical direction at a predetermined angle and rotated in an inclined position; and a cover member 34 which forms a coin containing space 33 for containing the coins between a surface of the centrifugal disk 32 and the cover member.

Each sorting unit 24 provided in the depositing and transporting unit 20 sorts the coins transported by this depositing and transporting unit 20 on the basis of results of coin recognition by the recognition unit 22, and delivers the coins through the chutes 26 to a reject unit 47, an overflow box 49 or the escrow unit 40. In addition, the coins held in escrow in the escrow units 40 are selectively delivered to a return box 48 or each storing and feeding device 50.

As shown in FIG. 3, storing and feeding devices 50 are arranged in a plurality of rows, specifically in two rows, along the horizontal plane. There are four storing and feeding devices 50 provided in each row. Further, a chute 68 for guiding the coins fed from the storing and feeding device 50 is provided in each storing and feeding device 50. The plurality of chutes 68 are provided so as to correspond to each storing and feeding device 50. As shown in FIG. 3, each chute 68 is installed at a side of each storing and feeding device 50, between the storing and feeding devices 50 in one of the rows (four storing and feeding devices 50 in an upper row in FIG. 3) and the storing and feeding devices 50 in the other row (four storing and feeding devices 50 in a lower row in FIG. 3).

As shown in FIG. 2, each storing and feeding device 50 includes: a feeding unit 51 which feeds the coins; and a transport unit 60 which stores the coins delivered from each escrow unit 40 and feeds the stored coins to the feeding unit 51. The feeding unit 51 of each storing and feeding device 50 includes: a centrifugal disk 52 which is inclined to the vertical direction at a predetermined angle and rotated in an inclined position; and a cover member 54 which forms a coin storing space 53 for storing the coins between a surface of this centrifugal disk 52 and the cover member.

As shown in FIG. 2, the transport unit 60 in each storing and feeding device 50 includes an endless transport belt 62 which extends in a substantially horizontal direction. The coins delivered from each escrow unit 40 through the chute 46 are stacked on the transport belt 62. As the transport belt 62 moves cyclically in an arrow direction of FIG. 2, a stack of coins stacked on the transport belt 62 is knocked down and the coins are delivered to the coin storing space 53 formed between the centrifugal disk 52 and the cover member 54 in the feeding unit 51. Here, the transport belt 62 in the transport unit 60 and the centrifugal disk 52 in the feeding unit 51 are operated in synchronization with each other.

The coins fed from each storing and feeding device 50 are stored in the drawer 72 mounted on the carriage 70 through the chute 68 corresponding to the storing and feeding device 50. A configuration of such a drawer 72 will now be described using FIGS. 5A to 5C. FIG. 5A is a perspective view showing a configuration of the coin container receiving unit 74 of the drawer 72; FIG. 5B is a perspective view showing a configuration of various types of coin containers 76*a* and 76*b* placed in the coin container receiving unit 74; and FIG. 5C is a view showing various patterns of combinations of the coin containers 76*a* and 76*b* placed in the coin container receiving unit 74.

In the present embodiment, the drawer 72 includes: the coin container receiving unit 74 as shown in FIG. 5A; and a plurality of types of coin containers 76*a* and 76*b* having different shapes each of which can be placed in the coin container receiving unit 74. As the plurality of types of coin containers having different shapes, for example, the substantially rectangular parallelepiped coin container 76*a* as shown in FIG. 5B (a) and the coin container 76*b* having a capacity double that of the coin container 76*a* shown in FIG. 5B (a) are used. Compared with the coin container 76*a* as shown in FIG. 5B (a), the coin container 76*b* as shown in FIG. 5B (b) has substantially equal depth and height but is about twice as wide.

As shown in FIG. 5C (a), the coin container receiving unit 74 has a shape which allows eight coin containers 76*a* to be placed therein. In particular, similar to the arrangement of the storing and feeding devices 50 as shown in FIG. 3, the coin container receiving unit 74 allows the coin containers 76*a* to be placed in a plurality of rows, specifically in two rows, along the horizontal plane, and allows four coin containers 76*a* to be placed in each row. Thus, the number of rows of the coin containers 76*a* is equal to the number of rows of the storing and feeding devices 50. Each coin container 76*a* to be placed in the coin container receiving unit 74 in the drawer 72 corresponds to each storing and feeding device 50. More specifically, when the coin container 76*a* is placed in the coin container receiving unit 74, the coins dispensed from the corresponding one storing and feeding device 50 are stored in the coin container 76*a*. On the other hand, when the coin container 76*b* is placed in the coin container receiving unit 74, the coins dispensed from the corresponding two storing and feeding devices 50 are stored in the one coin container 76*b*.

As shown in FIGS. 1, 2, 5A, etc., an opening 74*a* is provided at a bottom part of the coin container receiving unit 74 where each of the coin containers 76*a* and 76*b* is to be placed. When the coin containers 76*a* and 76*b* are not placed in the coin container receiving unit 74, the coins delivered from each storing and feeding device 50 through the chute 68 to the drawer 72 are delivered through the opening 74*a* of the coin container receiving unit 74 to the collecting box 78 located at the lower side of the drawer 72. A structure of the collecting box 78 will be described in detail later.

Here, the number of the coin containers 76*a* and 76*b* installed in the drawer 72 can be changed according to the combination of each type of the coin containers 76*a* and 76*b* placed in the coin container receiving unit 74. For example, as shown in FIG. 5C (a), when only the coin containers 76*a* are placed in the coin container receiving unit 74, the number of the coin containers 76*a* installed in the drawer 72 becomes eight, which makes it possible to handle a case where the number of denominations of coins to be handled is eight, such as in the eurozone or the United Kingdom. On the other hand, when one wishes to dispense a large amount of coins of a particular denomination, the coin container 76*b* as shown in FIG. 5B (b) is used instead of the coin container 76*a* as shown in FIG. 5B (a), such that the coins of the denomination are stored in two storing and feeding devices 50 corresponding to this coin container 76*b*. Thus, by simultaneously dispensing the coins of the same denomination from the two storing and feeding devices 50, a large amount of coins can be quickly stored in the coin container 76*b*.

When the coin containers 76*b* as shown in FIG. 5B (b) are used, instead of the coin containers 76*a* as shown in FIG. 5B (a), the combination patterns of arrangement of the coin containers 76*a* and 76*b* placed in the coin container receiving unit 74 are, for example, those shown in FIGS. 5C (b), (c), and (d). In this case, four coin containers 76*a* and two coin containers 76*b* are used, making the number of the coin containers 76*a* and 76*b* installed in the drawer 72 six in total, which makes it possible to handle a case where the number of denominations of coins to be handled is six, such as in China and Norway.

It is also possible to use only the coin containers 76*b* as shown in FIG. 5B (b) without using the coin container 76*a* as shown in FIG. 5B (a). In this case, the combination patterns of arrangement of the coin containers 76*a* and 76*b* placed in the coin container receiving unit 74 are, for example, those shown in FIGS. 5C (e) and (f). In this case, four coin containers 76*b* are used, which makes it possible to handle a case where the number of denominations of coins to be handled is four, such as in the United States and Sweden.

FIG. 7 is a side view showing the coin depositing and dispensing machine 10 when the coin containers 76*a* and 76*b* are placed in the coin container receiving unit 74 in the pattern as shown in FIG. 5C (b), and FIG. 8 is a front view showing the coin depositing and dispensing machine 10 when the coin containers 76*a* and 76*b* are placed in the coin container receiving unit 74 in the pattern as shown in FIG. 5C (f).

Thus, in the present embodiment, the drawer 72 includes the coin container receiving unit 74 and the plurality of types of coin containers 76*a* and 76*b* having different shapes each of which can be placed in the coin container receiving unit 74, and the number of the coin containers 76*a* and 76*b* installed in the drawer 72 can be changed according to the combination of each type of coin containers 76*a* and 76*b* placed in the coin container receiving unit 74.

In the present embodiment, wheels 71 are provided in the carriage 70 to which the drawer is mounted in an attachable/detachable manner, and this carriage 70 is movable between a first position, as shown in FIGS. 1 and 2, where the coins dispensed from each storing and feeding device 50 are delivered to the drawer 72, and a second position where the coins stored in each of the coin containers 76*a* and 76*b* in the drawer 72 can be removed from these coin containers 76*a* and 76*b*. Specifically, the second position is a position outside of the casing 12 of the coin depositing and dispensing machine 10.

In the present embodiment, the drawer 72 is provided with a coin container detecting sensor 75 for detecting the type and the position of each of the coin containers 76*a* and 76*b* placed in the coin container receiving unit 74. A configuration of such a coin container detecting sensor 75 will now be described using FIG. 6. As shown in FIG. 6, the drawer 72 is provided with total six coin container detecting sensors 75, and each coin container detecting sensor 75 includes an emission unit 75*a* and a light receiving unit 75*b*. More particularly, each of the emission unit 75*a* and the light receiving unit 75*b* is provided at an outer edge part of the coin container receiving unit 74, and when no coin containers 76*a* and 76*b* are placed in the coin container receiving unit 74, light emitted from the emission unit 75*a* of each coin container detecting sensor 75 is received by the light receiving unit 75*b*. Here, in two coin container detecting sensors of the six coin container detecting sensors 75, the light emitted from the emission unit 75*a* travels in a longer direction of the coin container receiving unit 74, while in the other four coin container detecting sensors 75, the light emitted from the emission unit 75*a* travels in a shorter direction of the coin container receiving unit 74.

In the coin container 76*a* as shown in FIG. 5B (a), each of adjacent two side surfaces of four side surfaces is provided with a light shielding member 76*p* (see FIG. 6), and when such a coin container 76*a* is placed in the coin container receiving unit 74, the light emitted from the emission unit 75*a* of the coin container detecting sensor 75 is shielded by the light shielding member 76*p* so as not to be sent to the light receiving unit 75*b*. At this time, as shown in FIG. 6, a light shielding state is detected by one coin container detecting sensor 75, from which the light travels in the shorter direction, and one coin container detecting sensor 75, from which the light travels in the longer direction.

In the coin container 76*b* as shown in FIG. 5B (b), one side surface at a short side of four side surfaces is provided with the light shielding member 76*p* (see FIG. 6). When such a coin container 76*b* is placed in the coin container receiving unit 74, the light emitted from the emission unit 75*a* of the coin container detecting sensor 75 is shielded by the light shielding member 76*p* so as not to be sent to the light receiving unit 75*b*. At this time, when the coin container 76*b* is placed in the coin container receiving unit 74 in the shorter direction, the light shielding state is detected by one coin container detecting sensor 75 from which the light travels in the shorter direction. On the other hand, when the coin container 76*b* is placed in the coin container receiving unit 74 in the longer direction, the light shielding state is detected by one coin container detecting sensor 75 from which the light travels in the longer direction.

Thus, by using the six coin container detecting sensors 75 as shown in FIG. 6, it is possible to detect which type of the coin container of the coin containers 76*a* and 76*b* is placed in the coin container receiving unit 74, and when the coin container 76*b* is placed in the coin container receiving unit 74, it is possible to detect whether this coin container 76*b* is placed in the shorter direction or the longer direction.

As described above, the collecting box 78 is provided in the carriage 70 at the lower side of the drawer 72 in an attachable/detachable manner. As the collecting box 78, a type of collecting box to store coins of a plurality of denominations mixed together in one compartment, or a type of collecting box to store coins separately in a plurality of compartments according to the denomination is used.

In FIGS. 1 and 2, the type of collecting box 78 to store coins of a plurality of denominations mixed together in one compartment is mounted on the carriage 70. In this case, as shown in FIGS. 9 and 10, the coin containers 76*a* and 76*b* are removed from the coin container receiving unit 74, and instead of them, a partitioning plate 79 having openings at an upper side and a lower side is placed in the coin container receiving unit 74, so that the coins delivered to the drawer 72 from each chute 68 are stored in the collecting box 78 through the opening 74*a* of the coin container receiving unit 74. Then, the carriage 70 is moved from the first position as shown in FIGS. 9 and 10 to the second position which is a position outside the casing 12 of the coin depositing and dispensing machine 10, thereby collecting the coins together with the collecting box 78.

A case where the type of collecting box 78*a* to store the coins separately in a plurality of compartments according to the denomination is mounted on the carriage 70 will now be described using FIGS. 11 and 12. As shown in FIGS. 11 and 12, also when the type of collecting box 78*a* to store the coins separately in a plurality of compartments according to the denomination is mounted on the carriage 70, the coin containers 76*a* and 76*b* are removed from the coin container receiving unit 74, and instead of them, the partitioning plate 79 having the openings at the upper side and the lower side is placed in the coin container receiving unit 74, such that the coins delivered from each chute 68 to the drawer 72 are stored in the collecting box 78*a* through the opening 74*a* of the coin container receiving unit 74. At this time, as the collecting box 78*a* is partitioned into a plurality of compartments, the coins are stored separately in the plurality of compartments according to the denomination. This makes it possible to collect the coins according to the denomination. Then, the carriage 70 is moved from the first position as shown in FIGS. 11 and 12 to the second position which is a position outside the casing 12 of the coin depositing and dispensing machine 10, thereby collecting the coins together with the collecting box 78*a*.

In the coin depositing and dispensing machine 10 of the present embodiment, the control unit 80 which controls each component of the coin depositing and dispensing machine 10 is provided. FIG. 4 is a functional block diagram of the coin depositing and dispensing machine 10 shown in FIG. 1, etc. A configuration of the control unit 80 will now be described with reference to FIG. 4.

As shown in FIG. 4, the control unit 80 is connected to the depositing and transporting unit 20, the recognition unit 22, containing and feeding device 30, the escrow unit 40, the feeding unit 51 and the transport unit 60 in the storing and feeding device 50, and the like, and transmits/receives signals to/from these components. More particularly, signals related to results of coin recognition by the recognition unit 22 are transmitted to the control unit 80. Further, the control unit 80 transmits control signals to the depositing and transporting unit 20, the containing and feeding device 30, the escrow unit 40, the feeding unit 51 and the transport unit 60 in the storing and feeding device 50, and the like, thereby controlling each of these components.

A notification unit 82 is connected to the control unit 80, and this notification unit 82 allows various notifications to be made to an operator by display, voice, or the like. In addition, an operation unit 84 which allows the operator to give various commands to the control unit 80 is provided. As one example of these notification unit 82 and operation unit 84, a touch panel is known which is provided in a front surface or an upper surface of the casing 12, and in which the notification unit 82 and the operation unit 84 are integrated.

A memory unit 86 is connected to the control unit 80, and information on various settings of the coin depositing and dispensing machine 10, processing results of the coins by the coin depositing and dispensing machine 10, and the like, is stored in the memory unit 86. Specifically, information related to setting of the denominations of coins to be sorted by each sorting unit 24 provided in the depositing and transporting unit 20, and information on a number and an amount of coins of each denomination stored in each storing and feeding device 50 are stored in the memory unit 86.

An interface 88 is connected to the control unit 80, and the control unit 80 can transmit/receive the signals to/from an external device (e.g., higher-ranking device) of the coin depositing and dispensing machine 10 through the interface 88.

As shown in FIG. 4, each of denomination setting unit 90 and abnormal state outputting unit 92 is connected to the control unit 80. The denomination setting unit 90 sets the denomination of coins to be stored in each storing and feeding device 50. More particularly, the denominations of the coins to be stored in each storing and feeding device 50 are set in the denomination setting unit 90 by the operator's input through the operation unit 84.

When the combination of each type of the coin containers 76*a* and 76*b* placed in the coin container receiving unit 74 and the denomination of the coins to be stored in each storing and feeding device 50 are set such that the coins of a plurality of denominations dispensed from each storing and feeding device 50 are stored in one coin container 76*a* or 76*b*, the abnormal state outputting unit 92 outputs information that an abnormal state exists. Specifically, in a case where the setting is such that the coin container 76*b* is placed in the coin container receiving unit 74 and coins of different denominations are stored in two storing and feeding devices 50 corresponding to this coin container 76*b*, the information that an abnormal state exists is output by the abnormal state outputting unit 92. When the information that an abnormal state exists is output by the abnormal state outputting unit 92, this is notified to the operator by the notification unit 82, stored in the memory unit 86, or transmitted to the external device (e.g., higher-ranking device) of the coin depositing and dispensing machine 10 through the interface 88.

In the present embodiment, a weight of coins which can be collected at once can be set by the operation unit 84, and the like. Specifically, in which mode of a male mode and a female mode to operate can be set, and when the female mode is set, the number of coins to be stored in the collecting box 78 or 78*a* becomes smaller than when the male mode is set. That is, when the number of coins stored in the collecting boxes 78 and 78*a* reaches a predetermined number, the notification unit 82 notifies the operator of a message that the carriage 70 should be taken out from the casing 12 of the coin depositing and dispensing machine 10 and the collecting box 78 or 78*a* should be collected from the carriage 70. At this time, the "predetermined number of coins" differs between the male mode and the female mode. In addition, the notification unit 82 may be configured to notify, at this time, the operator of information on how many times of collection operation are still required. Further, instead of the male mode and the female mode, the number of the coins to be stored in the collecting box 78 or 78*a* may be set according to the operator.

Thus, according to the coin depositing and dispensing machine 10 and the drawer 72 of the present embodiment, the drawer 72 includes the coin container receiving unit 74 and the plurality of types of coin containers 76*a* and 76*b* having different shapes each of which can be placed in the coin container receiving unit 74, and the number of the coin containers 76*a* and 76*b* installed in the drawer 72 can be changed according to the combination of each type of the coin containers 76*a* and 76*b* placed in the coin container receiving unit 74. This makes it possible to change the number of the coin containers 76*a* and 76*b* in the drawer 72 according to the number of denominations of coins to be handled. In addition, when one wishes to dispense a large amount of coins of a particular denomination, the large amount of coins of the particular denomination can be dispensed by using the coin container having a large capacity as the coin container corresponding to the particular denomination (specifically, the coin container 76*b* as shown in FIG. 5B (b)).

In the coin depositing and dispensing machine 10 of the present embodiment, the carriage 70 which the drawer 72 can be attached to and detached from is provided, and this carriage 70 is movable between the first position (see FIGS. 1 and 2) where the coins dispensed from each storing and feeding device 50 are delivered to the drawer 72 and the second position (specifically, a position outside the casing 12 of the coin depositing and dispensing machine 10) where the coins stored in each of the coin containers 76*a* and 76*b* in the drawer 72 can be removed from the coin containers 76*a* and 76*b*. This allows the operator to easily take out the coins stored in the drawer 72.

In the coin depositing and dispensing machine 10 of the present embodiment, the drawer 72 is provided with the coin container detecting sensors 75 for detecting the type and the position of each of the coin containers 76*a* and 76*b* placed in the coin container receiving unit 74. This makes it possible to automatically detect the type and the position of each of the coin containers 76*a* and 76*b* placed in the coin container receiving unit 74.

In the coin depositing and dispensing machine 10 of the present embodiment, the denomination setting unit 90 for setting the denomination of the coins to be stored in each storing and feeding devices 50 is provided. In addition, the abnormal state outputting unit 92 is provided, which outputs information that an abnormal state exists, when the combination of each type of the coin containers 76*a* and 76*b* placed in the coin container receiving unit 74 in the drawer 72 and the denomination of the coins to be stored in each storing and feeding device 50 are set such that the coins of a plurality of denominations dispensed from each storing and feeding device 50 are stored in one coin container (specifically, the coin container 76*b* as shown in FIG. 5B (b)) in the drawer 72. This makes it possible to prevent coins of a plurality of denominations from being stored in the one coin container 76*b*.

In the coin depositing and dispensing machine 10 of the present embodiment, at least one of the coin containers 76*a* in the drawer 72 stores the coins dispensed from one storing and feeding device 50. In addition, at least one of the coin containers 76*b* stores the coins dispensed from a plurality of (specifically, two) storing and feeding devices 50.

In the coin depositing and dispensing machine 10 of the present embodiment, the plurality of storing and feeding devices 50 are disposed in a plurality of rows on the horizontal plane. In addition, the plurality of coin containers 76*a* are disposed in a plurality of rows on the coin container receiving unit 74, and the number of the rows of the storing and feeding devices 50 is equal to the number of the rows of the coin containers 76*a*.

In the coin depositing and dispensing machine 10 of the present embodiment, the opening 74*a* is provided at the bottom part of the coin container receiving unit 74 where each of the coin containers 76*a* and 76*b* is to be placed, and the collecting box 78 for collecting the coins can be installed at the lower side of the coin container receiving unit 74. This makes it possible to store the coins delivered from the chute 68, through the opening 74*a* of the coin container receiving unit 74, in the collecting box 78 by removing the coin containers 76*a* and 76*b* from the coin container receiving unit 74.

Note that the coin depositing and dispensing machine 10 and the drawer 72 of the present embodiment are not limited to the above-described aspects, and various changes can be made thereto.

For example, a coin container detecting unit for detecting the type and position of each of the coin containers 76*a* and 76*b* placed in the coin container receiving unit 74 is not limited to the coin container detecting sensor 75 as shown in FIG. 6. As another aspect, a configuration may be adopted where each of the coin containers 76*a* and 76*b* is provided with an ID chip, and the coin container receiving unit 74 is provided with a reader, so that information on the type of the coin containers 76*a* and 76*b* is stored in the ID chip provided in the coin containers 76*a* and 76*b*, and the information stored in the ID chip of the coin containers 76*a* and 76*b* is read by the reader provided in the coin container receiving unit 74.

The coin container used in the drawer 72 of the coin depositing and dispensing machine 10 of the present embodiment is not limited to the one, such as the coin container 76*a*, which stores coins dispensed from one storing and feeding device 50, or the one, such as the coin container 76*b*, which stores coins dispensed from two storing and feeding devices 50. As the coin container, a coin container which stores coins dispensed from three or more storing and feeding devices 50 may be used. In this case, for example, an L-shaped container or a rectangular parallelepiped container in which three coin containers 76*a* are combined may be used as the coin container. In addition, as the coin container of yet another configuration, a container in which four or more coin containers 76*a* are combined may be used.

10 coin depositing and dispensing machine
12 casing
14 coin receiving unit
20 depositing and transporting unit
20*a* upper transport part
20*b* return transport part
20*c* lower transport part
22 recognition unit
24 sorting unit
26 chute
30 containing and feeding device
32 centrifugal disk
33 coin containing space

34 cover member
40 escrow unit
46 chute
47 reject unit
48 return box
49 overflow box
50 storing and feeding device
51 feeding unit
52 centrifugal disk
53 coin storing space
54 cover member
60 transport unit
62 transport belt
68 chute
70 carriage
71 wheel
72 drawer
74 coin container receiving unit
75 coin container detecting sensor
75*a* emission unit
75*b* light receiving unit
76*a*, 76*b* coin container
76*p* light shielding member
78, 78*a* collecting box
79 partitioning plate
80 control unit
82 notification unit
84 operation unit
86 memory unit
88 interface
90 denomination setting unit
92 abnormal state outputting unit

What is claimed is:

1. A coin dispensing device, comprising:

a plurality of coin storing units configured to store coins and to dispense the stored coins; and a drawer configured to receive the coins dispensed from the plurality of coin storing units, the drawer including a coin container receiving unit and a plurality of types of coin containers having different shapes, each of the coin containers configured to be placed in the coin container receiving unit, wherein a number of the coin containers installed in the drawer is changed according to a combination of the types of the coin containers placed in the coin container receiving unit, wherein two or more of the coin storing units of the plurality of coin storing units are configured to store coins of the same denomination, and wherein one coin container of the plurality of types of the coin containers is configured to store the coins dispensed from the two or more of the coin storing units storing the coins of the same denomination.

2. The coin dispensing device according to claim 1, further comprising a moving member configured to be attachable to and detachable from the drawer, the moving member being movable between a first position, where the coins dispensed from each coin storing unit is delivered into the drawer, and a second position, where the coins stored in each coin container in the drawer are removable from each coin container.

3. The coin dispensing device according to claim 1, wherein the drawer is provided with a coin container detecting unit configured to detect a type and a position of each coin container placed in the coin container receiving unit.

4. The coin dispensing device according to claim 1, further comprising denomination setting unit configured to set a denomination of a coin to be stored in each coin storing unit.

5. The coin dispensing device according to claim 1, further comprising abnormal state outputting unit configured to output information that the coin dispensing device is in an abnormal state, when a combination of the types of the coin containers placed in the coin container receiving unit in the drawer and a denomination of the coins to be stored in each coin storing unit are set so as to store the coins of a plurality of denominations, dispensed from different coin storing units, into one coin container in the drawer.

6. The coin dispensing device according to claim 1, wherein at least one of the coin containers in the drawer is configured to store the coins dispensed from one of the coin storing units.

7. The coin dispensing device according to claim 1, wherein the one coin container configured to store the coins being the same denomination simultaneously dispensed from the two or more of the coin storing units.

8. The coin dispensing device according to claim 1, wherein the plurality of coin storing units are disposed in a plurality of rows in a horizontal plane.

9. The coin dispensing device according to claim 8, wherein the plurality of coin containers are disposed in a plurality of rows in the coin container receiving unit, and a number of the rows of the coin storing units is equal to a number of the rows of the coin containers.

10. The coin dispensing device according to claim 1, wherein an opening is provided at a bottom part of the coin container receiving unit where each coin container is to be placed, and a collecting unit configured to collect the coins can be installed under the coin container receiving unit.

* * * * *